United States Patent [19]

Legille et al.

[11] Patent Number: 4,559,839

[45] Date of Patent: Dec. 24, 1985

[54] APPARATUS FOR DRIVING AN OSCILLATING SPOUT

[75] Inventors: Edouard Legille, Luxembourg; Emile Lonardi, Bascharage, both of Luxembourg

[73] Assignee: Paul Wurth S.A., Luxembourg

[21] Appl. No.: 504,465

[22] Filed: Jun. 15, 1983

[30] Foreign Application Priority Data

Jun. 24, 1982 [LU] Luxembourg ..... 84224

[51] Int. Cl.[4] ..... F16H 27/02

[52] U.S. Cl. ..... 74/88; 74/105; 74/106; 74/520

[58] Field of Search ..... 74/88, 105, 106, 520

[56] References Cited

U.S. PATENT DOCUMENTS

| | | | |
|---|---|---|---|
| 2,539,308 | 1/1951 | Latour | 74/520 |
| 2,830,455 | 4/1958 | Harmon | 74/105 |
| 2,882,744 | 4/1959 | Keller | 74/520 |
| 2,884,803 | 5/1959 | Willis | 74/106 |
| 3,921,831 | 11/1975 | Takahashi et al. | 193/16 |
| 4,032,024 | 6/1977 | Genge et al. | 193/17 |
| 4,306,827 | 12/1981 | Tsutsumi et al. | 193/16 |
| 4,360,305 | 11/1982 | Dorsch | 193/16 |
| 4,368,813 | 1/1983 | Mailliet | 193/3 |

FOREIGN PATENT DOCUMENTS 1596116 7/1970 France .

*Primary Examiner*—Ronald C. Capossela
*Attorney, Agent, or Firm*—Fishman & Dionne

[57] ABSTRACT

A drive means for an oscillating spout is presented which includes a control mechanism which directs a control arm to perform the movement required by the spout and a transmission device which acts to transmit the control arm movement and reproduce it as spout movement. The control mechanism consists of a driving rod pivotally connected to an intermediate lever arm and a universal joint connecting the lever arm to the control arm. A novel movable torque means is associated with the universal joint and enables the spout to be moved in and out of a vertical orientation by overcoming the tendency of the components of the control mechanism to become axially locked in a 180° angle. The movable torque means accomplishes this result by reducing the angle between the intermediate lever and control arm when that angle reaches 180°.

18 Claims, 6 Drawing Figures

16
0
40
36
34
32
14
12a
24
38
10
22
12
X
18
20

0
40
16
36
34
32
38
14
30
28
24
26
10
22
12
X
18
20

0
16
40
36
34
32
14
38
10
24
12
18
20

APPARATUS FOR DRIVING AN OSCILLATING SPOUT

BACKGROUND OF THE INVENTION

This invention relates to the field of drive means for oscillating spouts. More particularly, this invention relates to a new and improved apparatus for driving an oscillating spout for a shaft furnace, the spout being capable of pivoting about two orthogonal axes under the action of a pivoting control arm.

Apparatus of this generaly type has been described in French patent application No. 80 13 890, which relates to an apparatus for the distribution of charging material in a blast furnace. This French patent application discloses a preferred embodiment wherein the control arm is mounted outside the furnace head. A transmission device which translates the movement of the control arm to the spout is constructed so that the distribution spout and the control arm are always parallel to each other. To distribute the charge material in a circular trajectory, the control arm turns about a vertical axis parallel to the vertical axis of the furnace about which the spout is required to turn. In order to modify the angle of inclination of the spout which, in turn, modifies the radius of the circular trajectory in which the charge material is deposited, a change is made to the angle of inclination of the control arm in relation to its central axis of rotation. An intermediate lever together with the control arm form a rotating hinge with a variable angle of opening (i.e., the included angle). It is this angle of opening which determines the angle of inclination of the control arm and that of the spout in relation to the vertical axis of the furnace.

Unfortunately, despite its simple design, the driving device for the control arm of this French application does not allow the distribution spout to be oriented vertically (i.e., it does not enable the charging material to be deposited in the center of the charging surface). Vertical orientation of the spout can only be achieved by positioning the hinge formed by the intermediate lever and the control arm to form an angle of 180° such that the driving rod, the intermediate lever and the control arm are all aligned with one another. Although it is possible to accomplish such an alignment, it is thereafter impossible to move the elements out of this vertical positioning in a controlled manner, since a force exerted on the driving rod, no matter how great, cannot effect controlled modification of the hinge angle once the angle has reach 180 degrees. Only a force directed from the side would be able to unlock the vertical orientation.

SUMMARY OF THE INVENTION

The above-discussed and other problems of the prior art are overcome or alleviated by the driving apparatus for oscillating spouts of the present invention. In accordance with the present invention, a driving device is presented in which the distribution spout can be oriented vertically without remaining locked in that position.

The present invention provides an apparatus for driving an oscillating spout capable of pivoting about two orthogonal axes under the action of a pivoting control arm having the same degrees of liberty as the spout. An embodiment of the present invention includes a control mechanism which directs the control arm to perform the movement required by the spout and a transmission device which acts to transmit the control arm movement to the spout to reproduce it as spout movement, and vice versa.

The control mechanism of the present invention consists of a driving rod capable of both turning about its longitudinal axis and undergoing axial displacement. The driving rod is connected to and is driven by two independent driving means to effect these two movements. The end of the driving rod is pivotally attached to an intermediate lever which is pivotally attached, in turn, by a universal joint to the end of the control arm. The arrangement of the rod, lever and arm is such that a longitudinal displacement of the driving rod changes the angle of inclination of the control arm in relation to a central axis coaxial with the driving rod while a rotational movement by the driving rod creates a conical precessional movement of the control arm about the central axis. The universal joint of the present invention is associated with movable torque means which reduces the included angle formed by the hinge (lever and control arm) when this included angle reaches 180°.

In a first embodiment of the present invention, the movable torque means consists of a pusher or piston loaded by the action of a coil spring means. The piston and spring means are connected at one end to a first shoulder on the driving rod; and the other end of the piston contacts a flange extending from the intermediate lever. The spring loaded piston contacts the flange only when the assembly of the control arm, lever and driving rod approaches the open 180° position, whereby a torque is applied through the flange to the lever resulting in desired force and movement of the lever and control arm to reduce the angle to less than 180°.

A second embodiment of the present invention comprises a concentric ring positioned around the driving rod and capable of axial movement. The ring is connected to a spring loaded piston which acts to keep the ring in an inoperative position, A motor operates in opposition to the spring force to move the ring into an operative position whereby it interacts with a roller directly or indirectly connected with the intermediate lever, so as to cause the lever to assume an inclined position in relation to the longitudinal axis of the driving rod. The roller may be mounted on an extension from the lever such that the rotational axis of the roller is perpendicular to the longitudinal axis of the intermediate lever. The motor means by which the ring is moved will preferably consist of a hydraulic jack or an electric motor. In order to ensure that it will be secured in position and guided axially, the concentric ring is preferably provided with a guide roller which is constrained to a fixed groove parallel to the axis of the driving rod.

The structural design of the present invention enables the spout to be oriented in a thru vertical position by moving the driving rod longitudinally whereby the hinge (intermediate lever and control arm) can be opened to its maximum extent. But, unlike the prior art device which locks up in the 180° position, the two embodiments of the present invention permit a change from the 180° position under a controlled movement. In the first embodiment, the movement takes place in opposition to force exerted by a spring loaded pusher or piston wherein the spring closes the hinge (i.e., reduces the angle to less than 180°) when the driving rod has been lowered, thereby deflecting the linkage and the spout from its vertical position.

In the second embodiment of the present invention, the movement of the spout and linkage from a vertical position is effected by an axial displacement of the ring under the action of the motor resulting in pivoting action caused by the torque on the intermediate lever.

Of course, it will be understood that the force of the spring on the motor must be sufficient to overcome the force exerted by the weight of the spout.

The above discussed and other advantages of the present invention will be apparent to and understood by those skilled in the art from the following detailed description and drawings:

BRIEF DESCRIPTION OF THE DRAWINGS

Referring now to the drawings, wherein like elements are numbered alike in the several figures.

DESCRIPTION OF THE PREFERRED EMBODIMENT

Figures 1, 2, 3:
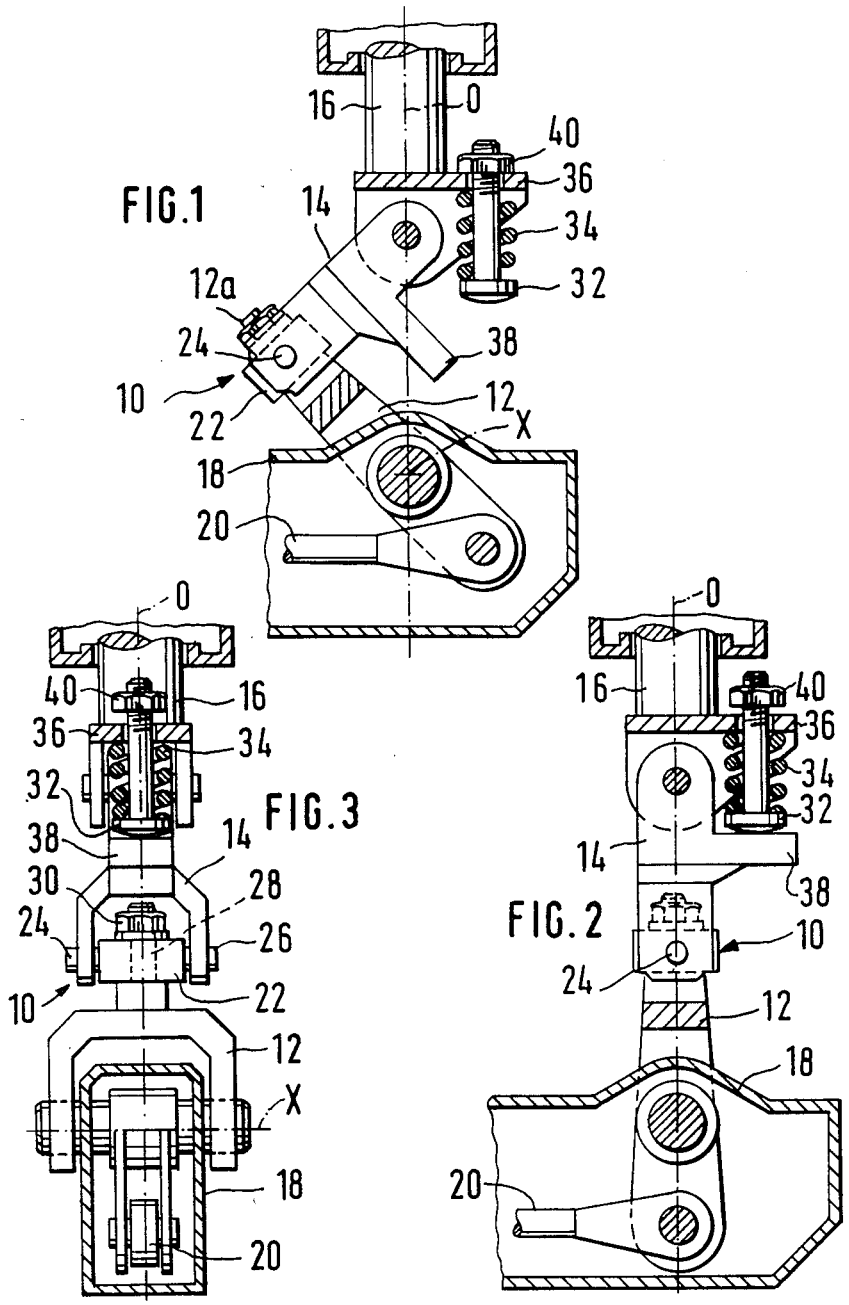
FIG. 1 is a front elevational view, partly in section, of a driving means in accordance with a first embodiment of the present invention.
FIG. 2 is a front elevational view, partly in section, of the drive means of FIG. 1 fully opened so that the distribution spout is vertically oriented.
FIG. 3 is a side elevational view of the drive means of FIG. 2.

Referring to FIG. 1, a hinge 10 having a variable (i.e., adjustable) angle of opening and capable of rotating about a vertical axis O is shown. This hinge consists of a control arm 12 which pivots about an axis X perpendicular to the plane of the drawing, and of an intermediate lever 14.

The control arm 12 is connected by means of a suitable transmission mechanism to a distribution spout (not shown) in the drawings. This transmission mechanism is preferably of the type disclosed in European patent application No. 82 101 943 and consists of a transmission bar 20 actuated pivoting control arm 12 and performing its cycle of movements inside a tight fork 18 capable of pivoting about its longitudinal axis.

The intermediate lever 14 is connected to a driving rod 16 actuated by suitable driving means (not shown) and which are capable of causing the rod 16 to turn about the axis O and/or of displacing it longitudinally along the axis O. These movements cause the rotation of the hinge 10 about the axis O and/or a modification of its angle of opening (i.e., the included angle between arm 12 and lever 14).

The conversion of this conical precession movement of the control arm 12 about the axis O into a corresponding movement of the distribution spout is explained in greater detail in the French and European patent applications previously referred to, the entire disclosures of which are incorporated herein by reference and to which reference should be made for these additional explanations.

Control arm 12 and lever 14 are connected by a universal joint which enable the angle of opening of hinge 10 to be changed by a rotational movement of the driving rod 16 as well as a relative pivoting movement between the control arm 12 and the lever 14 about the longitudinal axis X of the control arm 12. FIG. 3 illustrates an embodiment of a prior art universal joint of this kind. In this embodiment, the lower end of the intermediate lever 14 is in the form of a bifurcated or fork member wherein connecting block 22 is connected by two journals 24 and 26 to the two prongs of the fork member of the lever 14. This connecting block 22 can thus pivot about the axis of the journals 24 and 26 in relation to the lever 14; and lever 14 can similarly pivot about the connecting block 22.

Connecting block 22 is also provided with a central passage 28, the axis of which is perpendicular to the axis of the journals 24 and 26. A cylindrical extension **12*a* on arm 12 extends through passage 28 and is pivotally mounted in passage 28. Thus, extension 12*a* on the upper end of the control arm 12 permits relative rotation to take place between the cylindrical extension 12*a* and the passage 28 and block 22. To secure the control arm 12 in position in the connecting block 22, a screw threading can be provided on the end of the extension 12*a* which is fitted with a fastener, such as that shown at 30**.

To orientate the distribution spout fully vertically, the driving rod 16 must be raised until the hinge 10 is completely open (i.e., 180°) and occupies the position shown in FIG. 2, i.e., wherein the driving rod 16, the intermediate lever 14 and the control arm 12 are aligned coaxially on the axis O. As discussed previously, in the prior art, it has been impossible to return the structure in a controlled manner from the position shown in FIG. 2 to a configuration as shown in FIG. 1 without an external side force. Simply exerting a downward force on the driving rod 16 is not adequate since the components become locked in a 180° position without the novel improvement of the present invention.

A first embodiment of the present invention is shown in FIGS. 1–3, wherein a movable pusher or piston 32 is mounted on a shoulder 36 integral with the driving rod 16. This pusher 32 is loaded by the force of a helical spring 34 between shoulder 36 and the head of the pusher which normally keeps the pusher 32 in the position shown in FIG. 1. The length of the pusher 32 is adjustable by means of a nut 40 in such a way that when the hinge is opened by a displacement of the driving rod 16 from the position shown in FIG. 1 to that shown in FIG. 2 a flange 38 on the intermediate lever 14 acts on the pusher 32 against the action of the spring 34 (see FIG. 2). This compresses the spring, which, in turn, imposes a clockwise torque on flange 38 and lever 14. Consequently, by slackening or reversing the action on the driving rod 16, in the position shown in FIG. 2, the action of the spring 34 on the pusher 32 and the flange 38 rotates the intermediate lever 14 clockwise away from the axial postion shown in FIG. 2, i.e., to reduce the angle between lever 14 and arm 12 to less than 180° and remove the spout from the vertical position.

Figure 4:
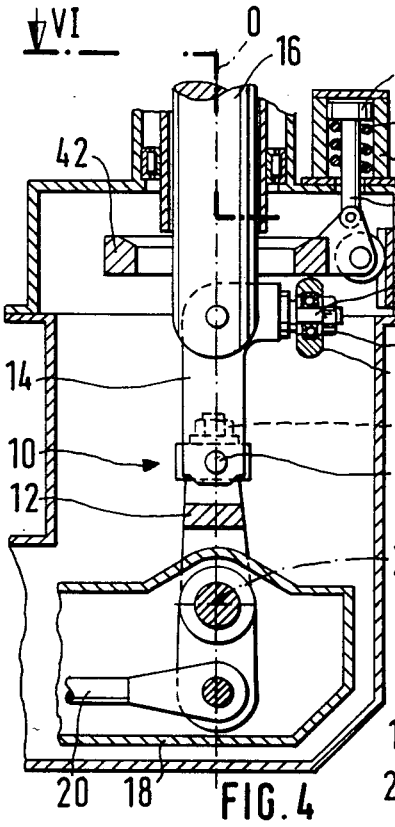
FIG. 4 is a front elevational view, partly in section, of a drive means in accordance with a second embodiment of the present invention in the fully opened position.
Figure 5:
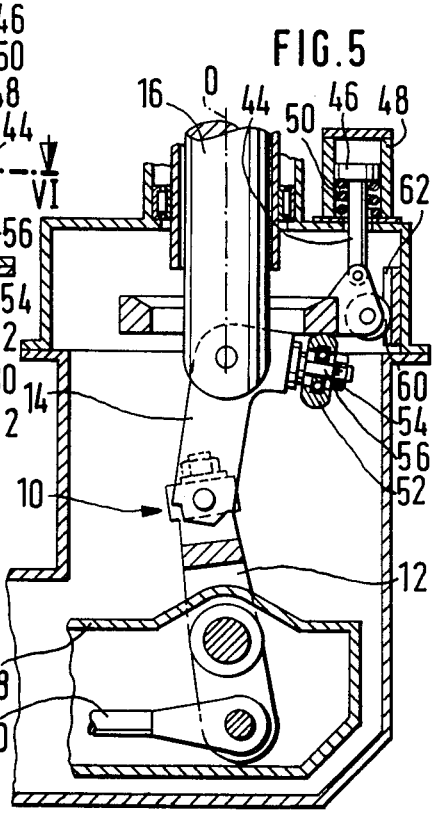
FIG. 5 is a front elevational view, partly in section, of the drive means of FIG. 4 in an inclined position.
Figure 6:
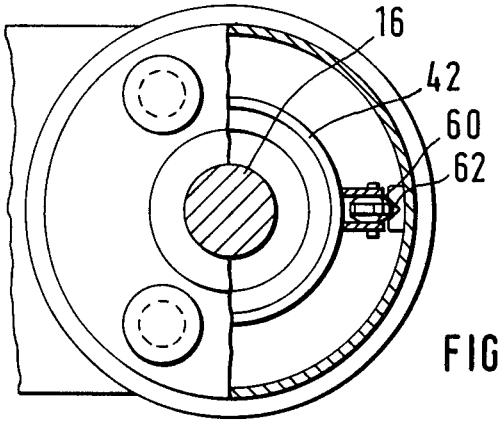
FIG. 6 is a sectional planar view of FIG. 4 taken along line VI—VI of FIG. 4.

In a second embodiment of the present invention shown in FIGS. 4–6 the elements 12–30 are identical with the elements, corresponding to the preceding diagrams and therefore will not be described in detail.

Referring jointly to FIGS. 4–6, a second embodiment of the present invention is shown which includes an alternate means to enable the spout to be moved from a vertical position. This second embodiment comprises a ring 42 which is slidably mounted coaxially around the rod 16. The ring is actuated by a piston rod 44, under whose action the ring 42 can vertically slide parallel to the axis O. This piston rod 44 may be actuated by hydraulic or electrical means and typically will be attached to a piston 46 which moves in the interior of a cylinder 48. A spring means 50 provided in the cylinder 48 around the piston rod 44 urges the rod 44 and the ring 42 to the inoperative (i.e., vertical) position shown in FIG. 4. In opposition to the upward force of the spring, a downward force is applied by such means as hydraulic or pneumatic fluid. This fluid pushes down against the piston 46 and enables the ring 42 to be moved downwardly (see FIG. 5). Different force generating means (other than a hydraulic or pneumatic jack) may be apparent to one skilled in the art for the purpose of lowering the ring 42 (i.e., electric motor), provided their action can be coordinated with that of the driving rod 16.

Downward movement of the ring 42 causes the intermediate lever 14 to pivot from the locked vertical position shown in FIG. 4 to a position similar to that shown in FIG. 5. To effect this pivoting, a roller 52 is mounted by a bearing 54 on extension 56, the extension being integral with or connected to the lever 14. The axis of the extension 56 should be perpendicular to the longitudinal axis of the lever 14. The roller 52 enables the rod 16 to freely rotate in relation to the non-rotary ring 46 while the ring 46 is in contact with the roller 52. The descent of the ring 42 caused by a downward force exerted by an appropriate means (i.e., hydraulic piston) is thus converted into a pivoting movement of the lever 14 under the torque exerted by the shaft 56 on the pivoting axis of the lever 14 to move the assembly out of 180° alignment of lever 14 and arm 12.

As shown in FIG. 6, to ensure that the ring 42 is held in the required radial position relative to rod 16, a preferred embodiment of the present invention employs a guide wheel 60 which travels, in a guide groove 62 provided on the fixed frame of the apparatus. A simple slide bar, or any other suitable device, could equally take the place of the guide wheel mechanism. Alternative means could be provided for axial displacement of the ring, such as by the direct action of gears, racks, worm gears, etc.

The two embodiments of the present invention thus present a controlled driving means for moving an oscillating spout in and out of a vertical position without encountering the undesirable locking problem. The drive means of the present invention is well suited for distributing charge material in a blast furnace.

The disclosures of European patent application No. 82 101 943 and French patent application No. 80 13 890 are referenced hereto and incorporated herewith.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. Apparatus for controlling the movement of an oscillating spout comprising:

a driving rod capable of rotation about its longitudinal axis and capable of axial displacement;

an intermediate lever arm connected at a first end to said driving rod by a pivotal connecting means;

a control arm to be connected to the oscillating spout;

universal joint means connecting a first end of said control arm to the second end of said intermediate lever arm;

torque generating means tending to reduce the angle formed between the longitudinal axis of said intermediate lever arm and the longitudinal axis of said control arm when said angle reaches 180°, said torque generating means including piston means connected between said driving rod and said intermediate lever;

flange means extending from said intermediate lever;

a shoulder extending from said driving rod;

piston means extending from said shoulder to said flange mean; and spring means acting on said piston to urge said piston against said flange means, whereby said piston applies a torque to said intermediate lever arm when the angle between said intermediate lever arm and said control arm reaches 180°.

2. The apparatus of claim 1 including:

adjusting means attached to said piston to regulate the travel of said piston.

3. Apparatus for controlling the movement of an oscillating spout comprising:

a driving rod capable of rotation about its longitudinal axis and capable of axial displacement;

an intermediate lever arm connected at a first end to said driving rod by a pivotal connecting means;

a control arm to be connected to the oscillating spout;

universal joint means connecting a first end of said control arm to the second end of said intermediate lever arm;

torque generating means tending to reduce the angle formed between the longitudinal axis of said intermediate lever arm and the longitudinal axis of said control arm when said angle reaches 180°;

said torque generating means including;

ring means positioned coaxially around said driving rod;

said ring means being movable in an axial direction with respect to said driving rod;

first force means to keep said ring means in an inoperative position;

second force means acting in opposition to said first means to move said ring to an operative position;

bearing means connected to said intermediate lever arm to contact said ring means when said ring means is in an operative position; and said bearing means exerting a torque on said intermediate lever arm upon said contact by said ring means.

4. The apparatus of claim 3 wherein:

said bearing means is a roller, said roller being rotationally mounted on an extension from said intermediate lever.

5. The apparatus of claim 4 wherein:

said extension connecting said roller to said intermediate lever arm comprises an extension member perpendicular to said lever arm; and said roller having a rotational axis about said extension member which is perpendicular to the longitudinal axis of the intermediate lever arm.

6. The apparatus of claim 3 wherein:

first force means is spring means operatively connected to said ring means; and said second force means is a fluid operated piston.

7. The apparatus of claim 3 including:

guide means connected to said ring means to maintain the radial position of said ring means.

8. The apparatus of claim 7 wherein said guide means includes:

a guide wheel connected to said ring means and movable in a track parallel to the axis of said driving rod.

9. Apparatus for driving and controlling the movement of an oscillating spout capable of movement about two orthogonal axes under the direction of a control arm having the same degrees of freedom of movement as the spout comprising:

a driving rod capable of rotation about its longitudinal axis and capable of axial displacement;

an intermediate lever arm having an axis and being connected at a first end to said driving rod by a pivotal connecting means;

a control arm having an axis and being connected to the oscillating spout to effect movement of said spout corresponding to movement of said control arm;

universal joint means connecting a first end of said control arm to the second end of said intermediate lever arm;

longitudinal displacement of said driving rod causing corresponding changes in the angles of inclination of the axes of said intermediate lever arm and said control arm relative to the longitudinal axis of the driving rod and rotation of said driving rod causing a conical precession movement of said control arm about said longitudinal axis; and torque generating means tending to reduce the angle formed between the longitudinal axis of said intermediate lever arm and the longitudinal axis of said control arm when said angle reaches 180° whereby said oscillating spout may be moved to and from a vertical position in a controlled manner.

10. The apparatus of claim 9 wherein:

said torque generating means includes piston means connected between said driving rod and said intermediate lever.

11. The apparatus of claim 10 including:

flange means extending from said intermediate lever;

a shoulder extending from said driving rod;

piston means extending from said shoulder to said flange; and spring means acting on said piston to urge said piston against said flange means, whereby said piston applies a torque to said intermediate lever arm when the angle between said intermediate lever arm and said control arm reaches 180°.

12. The apparatus of claim 11 including:

adjusting means attached to said piston to regulate the travel of said piston.

13. The apparatus of claim 9 wherein:

said torque generating means includes:

ring means positioned coaxially around said driving rod;

said ring means being movable in an axial direction with respect to said driving rod;

first force means to keep said ring means in an inoperative position;

second force means acting in opposition to said first means to move said ring to an operative position;

bearing means connected to said intermediate lever arm to contact said ring means when said ring means is in an operative position; and said bearing means exerting a torque on said intermediate lever arm upon said contact by said ring means.

14. The apparatus of claim 13 wherein:

said bearing means is a roller, said roller being rotationally mounted on an extension from said intermediate lever.

15. The apparatus of claim 14 wherein:

said extension connecting said roller to said intermediate lever arm comprises an extension member perpendicular to said lever arm; and said roller having a rotational axis about said extension member which is perpendicular to the longitudinal axis of the intermediate lever arm.

16. The apparatus of claim 13 wherein:

first force means is spring means operatively connected to said ring means; and said second force means is a fluid operated piston.

17. The apparatus of claim 13 including:

guide means connected to said ring means to maintain the radial position of said ring means.

18. The apparatus of claim 17 wherein said guide means includes:

a guide wheel connected to said ring means and movable in a track parallel to the axis of said driving rod.

* * * * *